United States Patent [19]

Ring et al.

[11] Patent Number: 4,749,001

[45] Date of Patent: Jun. 7, 1988

[54] NORMALLY CLOSED PNEUMATIC AIR VALVE

[75] Inventors: H. Kenneth Ring, Houston, Minn.; Dennis L. Manthei, West Salem; Steven C. Weber, La Crosse, both of Wis.

[73] Assignee: American Standard Inc., New York, N.Y.

[21] Appl. No.: 109,892

[22] Filed: Oct. 19, 1987

[51] Int. Cl.[4] ..... F16K 31/126

[52] U.S. Cl. ..... 137/219; 251/61.2

[58] Field of Search ..... 137/219; 251/61.2, 61.3, 251/61.4, 61.5

[56] References Cited

U.S. PATENT DOCUMENTS

| | | | |
|---|---|---|---|
| 2,821,343 | 1/1958 | Payne | 236/13 |
| 2,882,008 | 4/1959 | Giauque | 251/61.4 |
| 3,432,139 | 3/1969 | Jentoft | 137/219 X |
| 3,974,859 | 8/1976 | McNabney . | |
| 4,082,114 | 4/1978 | Hantke et al. . | |
| 4,177,970 | 11/1979 | Ring, Jr. . | |
| 4,305,418 | 12/1981 | Jensen et al. | 137/219 |

*Primary Examiner*—Gerald A. Michalsky

*Attorney, Agent, or Firm*—William J. Beres; David L. Polsley; Robert J. Harter

[57] ABSTRACT

A normally closed pneumatically actuated air valve for use in a variable air volume air distribution system has a unitary inlet section which supports a damper assembly and actuator through a support grid disposed in the inlet section. The damper assembly is mounted for axial movement, on a fixed spindle and guide piston, under the impetus of the expansion of a pressure chamber defined by a portion of the damper assembly and a diaphragm which conformably surrounds the guide piston. A biasing spring acts on a surface of the fixed guide piston and on the damper assembly to bias the damper assembly toward a seating surface of the inlet section.

20 Claims, 3 Drawing Sheets

NORMALLY CLOSED PNEUMATIC AIR VALVE

BACKGROUND OF THE INVENTION

The present invention relates generally to inventions which are the subject matter of concurrently filed patent applications U.S. Ser. Nos. 109,657 and 109,653 respectively entitled "Normally Open Pneumatic Air Valve" and "Electric Air Valve", both of which are assigned to the assignee of the present invention.

The present invention relates to a pneumatic air valve for use in an air distribution system wherein the volume of conditioned air supplied to a zone is varied in order to control the temperature within the zone.

One of the most common types of building ventilation systems is the variable air volume system wherein a central source provides conditioned air for distribution to various zones within a building via a network of ducts. Since heating and cooling requirements vary from zone to zone, and within individual zones, depending upon factors such as solar load and zone usage, it is necessary that provision be made to selectively control the amount of conditioned air supplied to a particular zone in response to local demand.

In a variable air volume system, the selective delivery of conditioned air to a particular zone is accomplished through the provision of at least one air distribution box associated with each zone. Such air distribution boxes define supply plenums and include one or more air outlets in communication with the associated zone. Additionally, each box has an air flow control valve, for varying the volume of air delivered into the controlled zone. Such air valves are controlled by a thermostat in the zone so as to supply the proper volume of conditioned air to maintain or achieve a selected zone temperature.

The present invention is directed to a normally closed pneumatic air valve assembly for use in a variable air volume air distribution system.

Typical pneumatically operated air valves are illustrated and described in U.S. Pat. Nos. 4,082,114, to Hantke et al., which is assigned to the assignee of the present invention, and 4,305,418, to Jensen et al. The valve of the Hantke patent includes a closed ended cylindrical portion downstream of the valve inlet in which a generally tubular valve member is disposed for movement axially of the valve housing. The size of a series of radial ports, and therefore the flow of air through the valve, is determined by the position of the valve member within the cylindrical, closed ended valve housing. The valve of the Hantke design is relatively complex and is, as well, somewhat expensive of manufacture. Additionally, dedicated sealing means are required at each peripheral edge of the tubular valve member in order to completely shut off air flow through the valve.

The Jensen valve is a normally closed valve the damper of which is disposed for axial movement interior of a solid, geometrically precise, unitary valve casing. The shape of the casing is critical and is selected so as to compensate for the variation of the drag coefficient of the valve which is a function of the position of the damper. Damper movement between the open and closed positions is entirely within the valve casing.

The need continues to exist for a normally closed pneumatic air valve which is uncomplicated and inexpensive of manufacture yet which provides for the precise control of the volume of air flowing through the valve. The present invention is directed to a normally closed pneumatic air valve which achieves the precise control of the volume of air flowing therethrough yet which is quiet, relatively inexpensive, needs no discrete seal structure and is extremely reliable.

SUMMARY OF THE INVENTION

It is an object of the present invention to provide an air valve assembly which includes a self-centering damper assembly and actuator means integral with the valve so as to eliminate the need for separately mounting the actuator portion of the valve.

It is another object of the present invention to provide an air valve assembly wherein the valve actuator is disposed entirely downstream of both the valve inlet and valve damper so as to achieve the quiet, controlled flow of air through the valve.

It is another object of the present invention to provide an air valve having a unitary die cast inlet which defines a venturi-like flow passage so as to reduce system static pressure requirements.

It is another object of the present invention to provide an air valve which employs essentially one moving part and which eliminates the need for set screws, levers, blades and mechanical linkages.

It is still another object of the present invention to provide an air valve having an inlet section which is configured for mounting to an air distribution box so as to support the entire structure of the valve assembly in a manner which allows for the efficient mounting of the valve to the box and removal of the valve therefrom.

It is another object of the present invention to provide a normally closed pneumatically operated air valve of reduced weight and complexity which eliminates the need for a discrete seal in order to achieve air flow shut off and which performs in a manner which meets or exceeds the performance of prior air valves.

These and other objects of the present invention, which will become apparent when the following Description of the Preferred Embodiment and attached drawing figures are simultaneously considered, are accomplished by an air valve having a unitary inlet section which defines a seating surface and a spider-like support grid in its upstream portion. For purposes of this patent, upstream will refer to the direction from which air is supplied to the valve while downstream will refer to the direction of air flow through the valve as is indicated by the arrows in the drawing figures.

A generally planar damper plate having a formed peripheral seating surface is pneumatically movable axially of the valve inlet section between a position wherein the damper seats on the inlet section seating surface and a position wherein the damper is retracted from that seating surface and out of the inlet section. A spindle is fixedly attached to and extends downstream of the support spider and is co-axial with respect to the axis of the inlet section. The spindle penetrates the damper plate which is slideably mounted thereon.

A closed housing is attached to and extends downstream of the damper plate. The housing envelops the downstream portion of the spindle. A diaphragm is disposed at the downstream end of the spindle, within the closed housing, so that a chamber is defined by the diaphragm and closed end of the housing into which pressurized air can be admitted. Attached to the spindle at its downstream end is a cup-like guide piston which is compliantly captured by the diaphragm and which is open at its upstream end. The guide piston is co-axial with the spindle and cooperates with the closed housing extending from the damper plate to constrain and control the shape and movement of the diaphragm internal of the housing.

A spring is disposed internal of the closed housing and acts on both the damper plate and the guide piston. Because the guide piston is fixedly attached to the spindle it is not movable with respect to the inlet section of the valve. The spring therefore acts on the damper plate to bias it toward the inlet section of the valve.

Therefore, when the damper assembly, which is an essentially unitary member comprised of the damper plate and the downstream extending closed housing, is not otherwise positioned under the influence of pressurized air admitted to the chamber defined by the housing and diaphragm, the spring moves the damper assembly into the closed position. In the closed position the formed damper plate seating surface abuts the cooperatively formed seating surface of the inlet section.

When air is admitted at a predetermined rate and at a predetermined pressure into the chamber defined by the diaphragm and closed ended housing, the volume of the chamber increases and the damper plate and the housing extending from the damper plate are urged away from the inlet section of the valve. Such movement effectively peels the diaphragm off of the guide sleeve which is fixed with respect to the valve's inlet section.

The continued admission of pressurized air to the chamber causes the volume of the chamber to continue to increase and the damper to be further retracted from the inlet section of the valve thereby compressing the spring trapped between the damper plate and the fixed guide piston. The damper plate continues to be retracted until its downstream surface seats on the open end of the fixed guide piston. When such abutment occurs the valve is in the fully open position.

The valve of the present invention advantageously provides for the precise control of the volume of conditioned air delivered to an air distribution box, is light weight and economical of manufacture. The valve is also, advantageously, of uncomplicated construction and has actuator apparatus which is entirely downstream of both the inlet section and damper plate so that an essentially unobstructed path is defined for air flowing through the valve. The essentially clean air flow path through the valve provides for extremely quiet air flow which is a significant feature and consideration in the employment of such valves. Further, no discrete sealing means is required to achieve the complete shutoff of airflow through the valve.

DESCRIPTION OF THE PREFERRED EMBODIMENT

Figure 1:
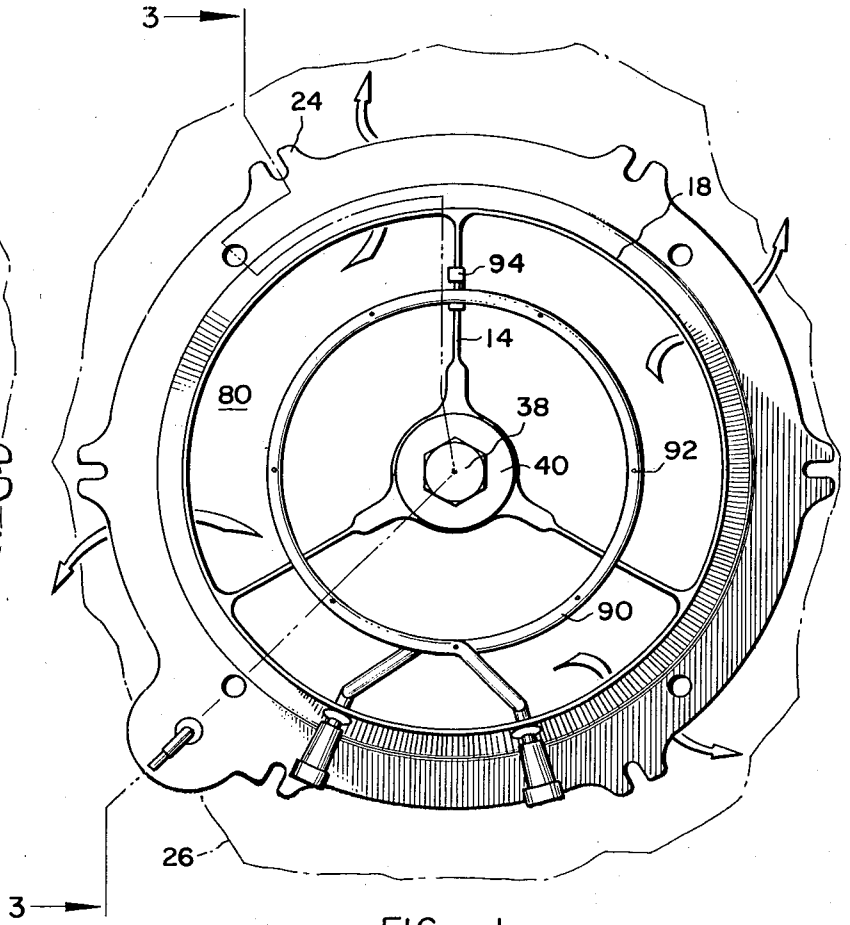
FIG. 1 is an end view of the air valve of the present invention as viewed from a position upstream of the valve.
Figure 2:
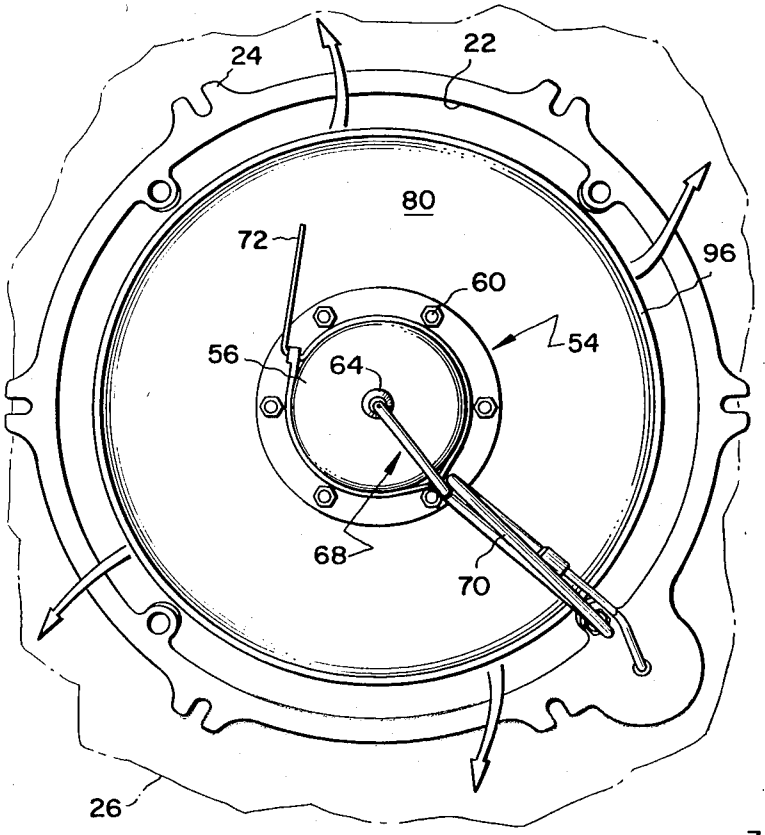
FIG. 2 is an end view of the valve of the present invention as viewed from a downstream position.
Figure 3:
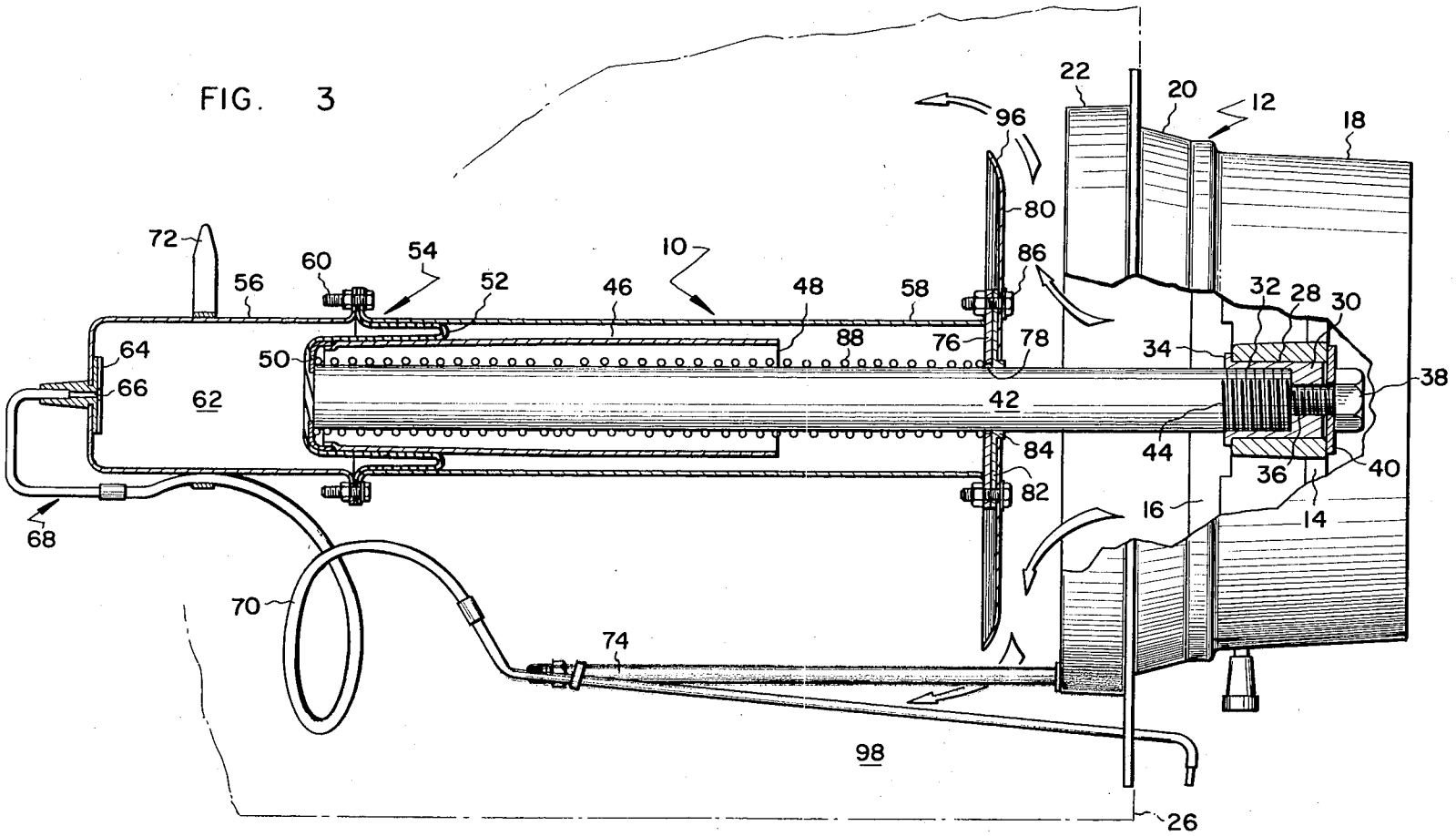
FIG. 3 is a cross-sectional view of the valve of the present invention taken along line 3—3 of FIG. 1 when the valve is in the partially open position.
Figure 4:
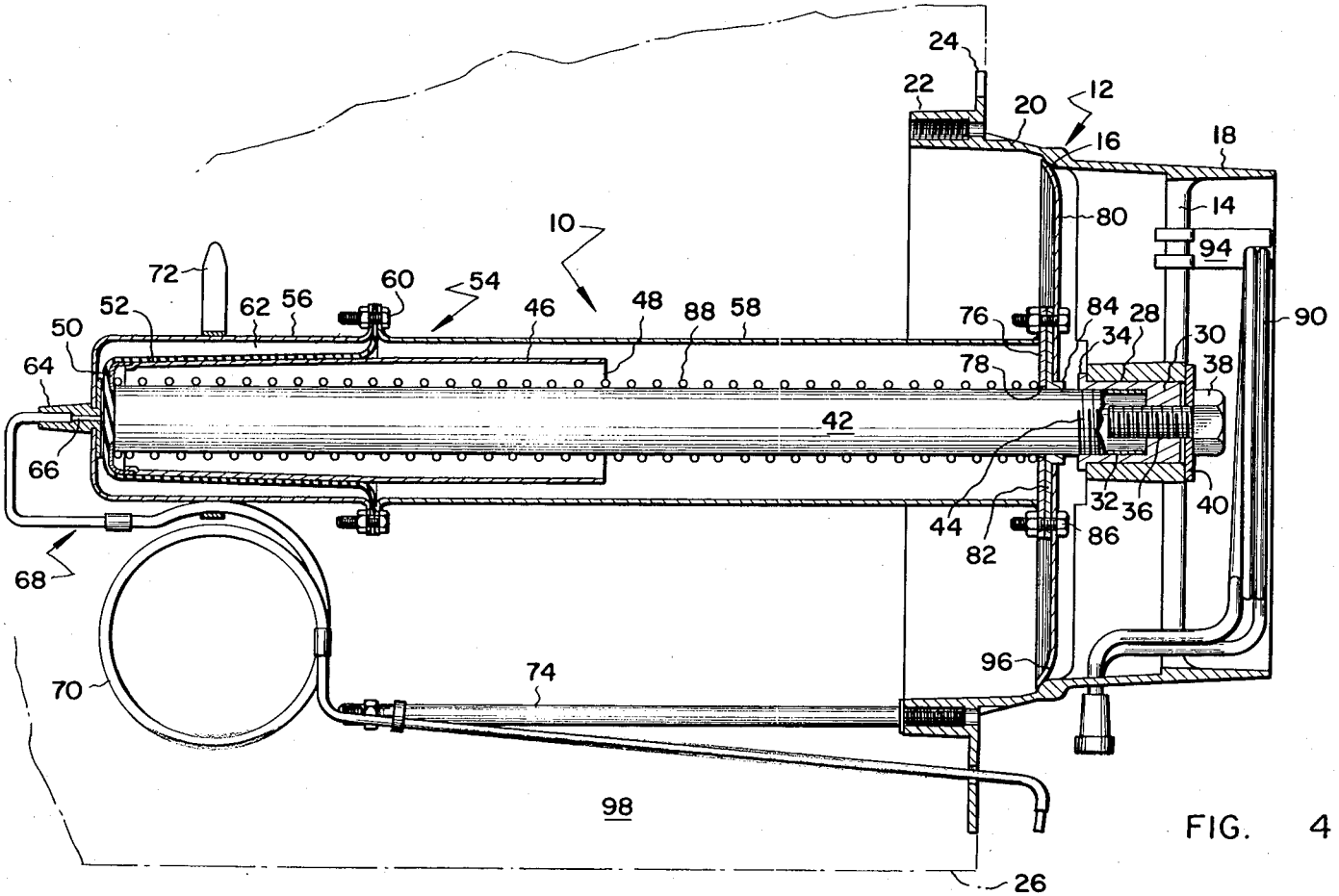
FIG. 4 is a cross-sectional view according to FIG. 3 wherein the valve of the present invention is shown in its closed position.

Referring to all of the drawing figures concurrently, valve 10 has a unitary, die cast, inlet section 12 which defines a spider-like support grid 14 and a seating surface 16. The geometry of the flow path defined by valve 10 is such that air flows through open ended inlet section 12 in a venturi-like manner which reduces static pressure requirements for the operation of a variable air volume system in which valve 10 is employed.

Upstream of seating surface 16 is a generally tubular inlet portion 18 in which grid 14 is disposed. Inlet portion 18 is configured to be received into the building ductwork through which conditioned air is supplied. Mounting portion 20 of the inlet section includes a generally annular support ring 22 from which attachment lugs 24 extend radially outward so as to permit the mounting of valve 10 to wall 26, shown in phantom, of an air distribution box.

Support grid 14 defines an aperture 28 in which a bushing 30 is disposed. Bushing 30 defines a first internally threaded void 32 and has a flange portion 34. Flange portion 34 abuts and seats against a downstream surface of support grid 14. A second threaded void 36 is defined in the upstream portion of bushing 30. Threaded into second threaded void 36 of bushing 30 is a bolt 38. Disposed between the head of bolt 38 and an upstream facing surface of support grid 14 is a washer 40. It will be appreciated that as bolt 38 is threaded into bushing 30, bushing 30 becomes securely ensconced in the aperture 28 defined by the support grid.

Threaded into the first threaded void 32 of the bushing 30 is a generally tubular spindle 42 having an upstream threaded portion 44. Spindle 42 is co-axial with the axis of inlet section 12 and is securely affixed to bushing 30 by the employment of an adhesive material, such as that having the trade name "Locktite", which is disposed between the threads of the spindle and the threads of the bushing. Spindle 42 therefore fixedly and rigidly extends downstream of inlet section 12.

Fixedly attached to the downstream end of spindle 42 is an open ended guide piston 46. Piston 46 defines an aperture 48 at its upstream end and cooperates at its downstream end with spindle 42 to define a seating surface 50. Spindle 42 and guide piston 46 together comprise fixed spindle means for supporting the axial movement of a damper assembly. Guide piston 46 is co-axial with spindle 42 and is fixed with respect to both the spindle and inlet section 12. A diaphragm 52 conformably envelops the downstream end of guide piston 46. Diaphragm 52 is disposed within a housing 54 which is comprised of a downstream closed ended section 56 and an upstream extending tubular portion 58.

The shape and movement of diaphragm 52 is determined and restrained by its cooperation with the outer surface of guide piston 46 and the inner surface of tubular portion 58 of housing 54.

Housing section 56 and tubular portion 58 each have cooperating flanges between which the edge of diaphragm 52 is sealingly trapped. Screws 60 penetrate the flanges of downstream section 56 and tubular portion 58 as well as the edge of diaphragm 52 so that a closed, sealed chamber 62 is defined between housing section 56 of housing 54 and diaphragm 52 and so that downstream section 56 and upstream extending tubular portion 58 are joined into an effectively rigid and unitary housing 54.

A grommet 64 defines an air passage 66 in flow communication with chamber 62. The portion of grommet 64 which is outside of downstream housing section 56 is connected to an air supply tube 68 through which air is delivered to and vented from chamber 62. Tube 68 has a coiled section 70 and is secured to housing 54 by means such as, for example, nylon cable tie 72. Extending downstream from inlet portion 12 is an optional rod 74 which is further employed to securely mount air tube 68 to the valve.

Fixedly attached to tubular portion 58 of housing 54 is a guide plate 76. Guide plate 76 defines an aperture 78 which is penetrated by spindle 42. Disposed between a damper plate 80 and guide plate 76 of housing 54 is a plastic bearing 82 which supports and guides the upstream end of the damper assembly. The damper assembly is an essentially unitary structure comprised of damper plate 80 and housing 54 both of which are movable, as a unit, axially of inlet section 12 to vary the volume of air flowing through the valve. Housing 54 cooperates with diaphragm 52 to comprise an actuator through which the movement of damper plate 80 is achieved.

Bearing 82 has a strengthened portion 84 which defines an aperture and which is slideably penetrated by fixed spindle 42. Damper plate 80 and bearing 82 are fixedly connected to guide plate 76 by screws 86 which penetrate the damper plate, the guide plate and the bearing. A compression spring 88 acts on guide plate 76 and on the fixed seating surface 50 of guide piston 46.

An air flow sensor 90, which defines a plurality of upstream facing apertures 92, is secured in inlet portion 18 of inlet section 12 by clips 94. By measurement of the static pressure developed in sensor 90 by the flow of air into inlet section 12, the volume of the air flowing through the valve can be measured.

In operation, when the pressure in chamber 62 is insufficient to overcome the biasing force of spring 88, spring 88, which acts against fixed seating surface 50, urges damper plate 80 into contact with the seating surface 16 of the inlet section. Upon the admission of pressurized air into chamber 62 the pressure in the chamber builds until the biasing force of spring 88 is ove-come. At the point where the biasing force of spring 88 is overcome, the volume of chamber 62 begins to expand thereby causing the damper assembly, comprised of housing 54 and damper plate 80, to be urged in a direction away from inlet section seating surface 16 and further causing diaphragm 52 to be peeled away from the guide piston.

The continued admission of pressurized air into chamber 62 urges damper plate 80 further in the downstream direction until guide platc 76, which is secured to damper plate 80, comes into abutment with the open ended portion of guide piston 46. At such time as the abutment of damper plate 80 and guide piston 46 occurs the valve is in its fully open position and damper plate 80 is retracted out of inlet section 12.

By selectively venting the pressure from chamber 62 the pressure therein is reduced and damper plate 80, under the urging of spring 88, is moved toward the inlet section of the valve. It will be appreciated that by controllably admitting air to and venting air from chamber 62, damper plate 80 can be positioned in the fully open position, the fully closed position or in any position therebetween so as to control the volume of air passing through valve 10 over a continuous range of flows.

Since plastic bearing 82 is penetrated by spindle 42 for free and slideable movement thereon and since diaphragm 52 is pliable, the damper assembly is compliantly mounted to the remainder of the valve structure. That is, the valve assembly is not, necessarily. aligned with the axis of fixed inlet section 12 or spindle 42 although preferrably it will be aligned.

As a result of such compliance, the damper assembly is self-centering and self-seating on seating surface 16 of the inlet section so that the slight misalignment of the damper assembly in operation does not result in the leakage of air past the damper plate when the valve is in the closed position. This is because beveled seating surface 96 at the peripheral edge of the damper plate 80 comes into contact with seating surface 16 of the inlet section 12 with sufficient force, under the impetus of spring 88, to cause a continuous seal to be formed therebetween. This continuous and tight seal is formed even if the non-symmetrical deformation of diaphragm 52 and the slight misalignment of the damper assembly from the true axis of spindle 42 results and even if this axis of spindle 42 is misaligned with the axis of inlet section 12. Once again, the forgiving nature of the valve is obtained due to the compliant mounting of the damper assembly, via diaphragm 52 to the fixed portion of the valve.

Because the only obstruction to air flow through the valve is support grid 14 and damper plate 80, the peripherally formed seating surface 96 of which acts to uniformly and smoothly deflect air into the plenum 98 of distribution box 26, the flow of air through valve 10 is extremely quiet. Because the weight of the damper assembly and actuator apparatus of the valve is supported entirely by spider 14 of the inlet section, eliminating the need for any other discrete support structure therefor, valve 10 is extremely lightweight and uncomplicated of manufacture. It is also easily mounted to and removed from air distribution boxes.

Further, since valve 10 does not have the set screws, levers or linkages found in other such valves, it is inherently more reliable than valves having such apparatus. The valve requires no lubrication or preventive maintenance and is not subject to sticking or jamming as are valves actuated through levers and linkages.

It will be appreciated that given the teachings herein many modifications might be made to the air valve of the present invention. Such modifications are, however, considered to be within the scope of the invention which is limited only by the language of the claims which follow.

What is claimed is:

1. A normally closed air valve comprising:

an inlet section having a flow passage in which a seating surface is defined and having a support grid upstream of said seating surface;

spindle means fixedly attached to said support grid and extending downstream thereof;

a damper assembly compliantly mounted for slideable movement on said spindle means;

means, acting on said damper assembly and on said spindle means for urging said damper assembly toward said seating surface of said inlet section; and means for actuating said valve, said actuating means including a diaphragm which cooperates with said damper assembly to define a closed chamber and which conformably entraps a portion of said spindle means, the expansion of said chamber cooperatively defined by said diaphragm and said damper assembly causing said damper assembly to move away from said seating surface of said inlet section.

2. The air valve according to claim 1 wherein said damper assembly comprises a generally planar damper plate and a closed ended housing extending downstream thereof, said diaphragm being disposed in the closed end of said housing.

3. The air valve according to claim 2 wherein said damper plate has a formed peripheral seating surface and is penetrated by said spindle means, the movement of said damper plate in a direction away from said seating surface of said inlet section being limited by its abutment with a portion of said spindle means.

4. The air valve according to claim 3 wherein the weight of said damper assembly is supported entirely by said inlet section through said spindle means.

5. The air valve according to claim 4 wherein said spindle means comprises a rod-like spindle having a cup-like guide piston disposed at its downstream end.

6. The air valve according to claim 5 wherein said valve is pneumatically operated so that the position of said damper plate is a function of the volume of said chamber, the volume of said chamber being a function of the admission and release of pressured air into and out of said chamber, said diaphragm conformably and compliantly interacting with said guide piston and said housing so that said damper assembly is self-centering in said inlet section.

7. A pneumatically operated air valve comprising:

an inlet section having a seating surface and a support grid;

guide means including a guide piston and a spindle, said spindle being fixedly attached at a first end to and extending downstream of said support grid, said guide piston being fixedly attached to the downstream end of said spindle and extending upstream thereof in a co-axially enveloping manner;

a damper plate disposed for slideable movement on said spindle between a closed position in which said damper plate contacts said inlet section seating surface and an open position in which said damper plate contacts said guide piston;

means for biasing said damper plate toward said inlet section seating surface; and actuator means, defining a closed expandable chamber, at least part of said chamber being defined by a diaphragm, said diaphragm overlaying said guide piston, the expansion of said chamber causing said damper plate to be urged away from said inlet section seating surface against the force of said biasing means.

8. The air valve according to claim 7 wherein said actuator means further comprises a closed ended housing attached to and extending downstream of said damper plate, said diaphragm interacting with said guide piston and said housing in a compliant fashion so that said damper plate is self-centering with respect to said seating surface of said inlet section.

9. The air valve according to claim 8 wherein said damper plate has a beveled edge and wherein said damper plate is penetrated by said spindle, said actuator being shielded from the flow of air into and through said valve by said damper plate, and said damper plate being retracted entirely out of said inlet section when in said open position.

10. The air valve according to claim 9 wherein said means for biasing comprises spring means acting on said guide piston and said damper plate.

11. A normally closed pneumatically operated air valve comprising:

a generally tubular unitary inlet section defining a venturi-like passage and a seating surface;

a damper plate moveable axially of the axis of said inlet section between a closed position in which said damper plate seats on said inlet section seating surface and a position in which said damper plate is retracted downstream and out of said inlet section;

means for biasing said damper toward said inlet section seating surface;

pneumatically operated actuator means for causing the movement of said damper plate along the axis of said inlet section, said actuator means including a diaphragm and a housing with which said diaphragm cooperates to define a pressure chamber, said housing being attached to said damper plate and said damper plate being moved away from said seating surface of said inlet section when the pressure in said chamber overcomes the force of said biasing means; and means, fixedly attached to said inlet section, for guideably supporting said actuator means and said damper plate.

12. The air valve according to claim 11 wherein said support means comprises a support grid disposed in said passage of said inlet section and spindle means extending downstream thereof in a co-axial relationship with the axis of said passage.

13. The air valve according to claim 12 wherein said spindle means comprises a rod-like spindle attached to said support grid and a guide piston attached to said rod-like spindle at the downstream end of said spindle, said guide piston cooperating with said actuator housing to constrain the shape and movement of said diaphragm.

14. The air valve according to claim 13 wherein said damper plate is penetrated by said rod-like spindle and is mounted thereon for slideable movement, the compliant nature of said diaphragm and the slideable mounting of said damper plate on said spindle cooperatively causing said damper plate to be self-centering within said inlet section so that upon abutment of said damper plate with said inlet section seating surface a continuous seal is formed therebetween irrespective of the misalignment of said damper plate with said seating surface prior to its abutment therewith.

15. The air valve according to claim 13 wherein said means for biasing comprises a spring, disposed in said housing, which acts on said guide piston of said spindle means and on the downstream face of said damper plate.

16. The air valve according to claim 13 wherein said means for guideably supporting includes a bushing attached to said damper plate and slideably penetrated by said rod-like spindle.

17. A normally closed pneumatically actuated air valve comprising:

a unitary inlet section defining a generally cylindrical flow passage and a seating surface, said inlet section having a support grid internal of said passage upstream of said seating surface;

spindle means extending downstream of said support grid for supporting the weight of said valve other than said inlet section;

a diaphragm enveloping the downstream end of said spindle means;

a closed ended housing enveloping both said diaphragm and the downstream end of said spindle means, the closed end of said housing and said diaphragm cooperating to define a closed chamber into which a passage for the admission and release of air opens;

a damper plate attached to the end of said housing opposite said closed end, said damper plate being slidingly penetrated by said spindle means; and means for urging said damper plate toward the seating surface of said inlet section.

18. The air valve according to claim 17 wherein said spindle means comprises a rod-like spindle portion attached to and extending downstream from said support grid and a guide piston attached to the downstream portion of said rod-like spindle, said diaphragm being trapped between said guide piston and said housing so that said housing and damper plate are compliantly mounted on said spindle means.

19. The air valve according to claim 18 wherein said damper plate has a seating surface formed for sealing engagement with said inlet section seating surface.

20. The air valve according to claim 19 wherein said means for urging comprises a spring acting on said damper plate and on said spindle means, the movement of said damper plate away from said inlet section being limited by the abutment of the damper plate with said guide piston.

* * * * *